US010035675B2

(12) United States Patent
Maruyama

(10) Patent No.: US 10,035,675 B2
(45) Date of Patent: Jul. 31, 2018

(54) SOLENOID DEVICE AND IMAGE FORMING APPARATUS THEREWITH

(71) Applicant: KYOCERA Document Solutions Inc., Osaka (JP)

(72) Inventor: Kei Maruyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 9 days.

(21) Appl. No.: 15/393,980

(22) Filed: Dec. 29, 2016

(65) Prior Publication Data

US 2017/0213630 A1 Jul. 27, 2017

(30) Foreign Application Priority Data

Jan. 26, 2016 (JP) ..... 2016-012089

(51) Int. Cl.

| | |
|---|---|
| ***B65H 29/58*** | (2006.01) |
| ***H01F 7/123*** | (2006.01) |
| ***G03G 15/00*** | (2006.01) |
| ***B65H 5/36*** | (2006.01) |
| ***H01F 7/18*** | (2006.01) |
| ***B65H 29/60*** | (2006.01) |

(52) U.S. Cl.

CPC ..... *B65H 29/58* (2013.01); *B65H 5/36* (2013.01); *B65H 29/60* (2013.01); *G03G 15/6529* (2013.01); *H01F 7/123* (2013.01); *H01F 7/1805* (2013.01); *B65H 2555/13* (2013.01); *B65H 2555/132* (2013.01)

(58) Field of Classification Search

CPC ..... H07F 7/123; H07F 7/1805; H07F 7/1827; H07F 7/1833; B65H 2555/13; B65H 2555/132; B65H 2555/134; B65H 29/58; B65H 29/60

See application file for complete search history.

(56) References Cited

U.S. PATENT DOCUMENTS 5,510,951 A * 4/1996 Briedis ..... H01H 47/325 361/154
5,523,684 A * 6/1996 Zimmermann ..... G01D 5/147 324/207.2

(Continued)

FOREIGN PATENT DOCUMENTS

JP 2000-124028 A 4/2000

*Primary Examiner* — Jeremy R Severson

(74) *Attorney, Agent, or Firm* — Stein IP, LLC

(57) ABSTRACT

A solenoid device has a solenoid and a control portion. The solenoid has a body, a plunger, an attracting coil, a retaining coil, and a biasing member. The plunger is arranged selectively either in an attracted position, pulled into the body, or in a returning position, protruding out of the body. Fed with a voltage, the attracting coil generates an attracting force causing the plunger to move from returning position to attracted position. Fed with a voltage, the retaining coil generates a retaining force, weaker than the attracting force, causing the plunger to move to attracted position. The biasing member biases the plunger toward returning position. The control portion controls operation of the solenoid. When moving the plunger from returning position to attracted position, the control portion first starts applying the voltage to the retaining coil and then starts applying the voltage to the attracting coil.

11 Claims, 6 Drawing Sheets

(56) References Cited

U.S. PATENT DOCUMENTS

| | | | | |
|---|---|---|---|---|
| 5,592,356 | A * | 1/1997 | Ryl | F02D 41/20 361/142 |
| 6,968,859 | B1 * | 11/2005 | Nagano | H01F 7/1607 137/554 |
| 8,421,565 | B2 * | 4/2013 | Santichen | F02N 11/087 335/255 |
| 8,838,008 | B2 * | 9/2014 | Nara | B65H 29/58 271/184 |
| 2007/0240775 | A1 * | 10/2007 | Crnkovich | F16K 31/06 137/625.65 |
| 2009/0244801 | A1 * | 10/2009 | Yang | H01F 7/1805 361/154 |
| 2010/0044957 | A1 * | 2/2010 | Yang | B65H 29/58 271/225 |

* cited by examiner

--Related Art--

--Related Art--

SOLENOID DEVICE AND IMAGE FORMING APPARATUS THEREWITH

INCORPORATION BY REFERENCE

This application is based upon and claims the benefit of priority from the corresponding Japanese Patent Application No. 2016-012089 filed on Jan. 26, 2016, the entire contents of which are incorporated herein by reference.

BACKGROUND

The present disclosure relates to a solenoid device and to an image forming apparatus incorporating the solenoid device, such as a copier, a printer, or a facsimile machine.

Conventionally, as a driving source of a movable member in an electronic device such as an image forming apparatus, a solenoid device is widely used. The solenoid device has a plunger (movable iron core) normally located at a position away from a coil by a spring, and when the coil is magnetically excited, the plunger moves toward the coil.

In a solenoid device as described above, impact noise and vibration inconveniently occur when a plunger operates. As a solution, various methods have been proposed for suppressing impact noise and vibration occurring when a plunger operates; for example, an electromagnetic solenoid is known in which a sound-absorbing/sound-muffling material is interposed between a flapper (movable piece) and a supporting portion which supports the flapper.

SUMMARY

According to one aspect of the present disclosure, a solenoid device includes a solenoid and a control portion. The solenoid includes a solenoid body, a plunger, an attracting coil, a retaining coil, and a biasing member. The plunger is arranged selectively either in an attracted position where the plunger is pulled into the solenoid body or in a returning position where the plunger protrudes out of the solenoid body. The attracting coil is arranged in the solenoid body, and generates, when a voltage is applied thereto, an attracting force that causes the plunger to move from the returning position to the attracted position. The retaining coil is arranged in the solenoid body, and generates, when a voltage is applied thereto, a retaining force that causes the plunger to move to the attracted position and that is weaker than the attracting force of the attracting coil. The biasing member biases the plunger toward the returning position. The control portion controls operation of the solenoid. When performing attracting operation to move the plunger from the returning position to the attracted position, the control portion first starts to apply the voltage to the retaining coil and then starts to apply the voltage to the attracting coil.

Further features and advantages of the present disclosure will become apparent from the description of embodiments given below.

DETAILED DESCRIPTION

Figure 1:
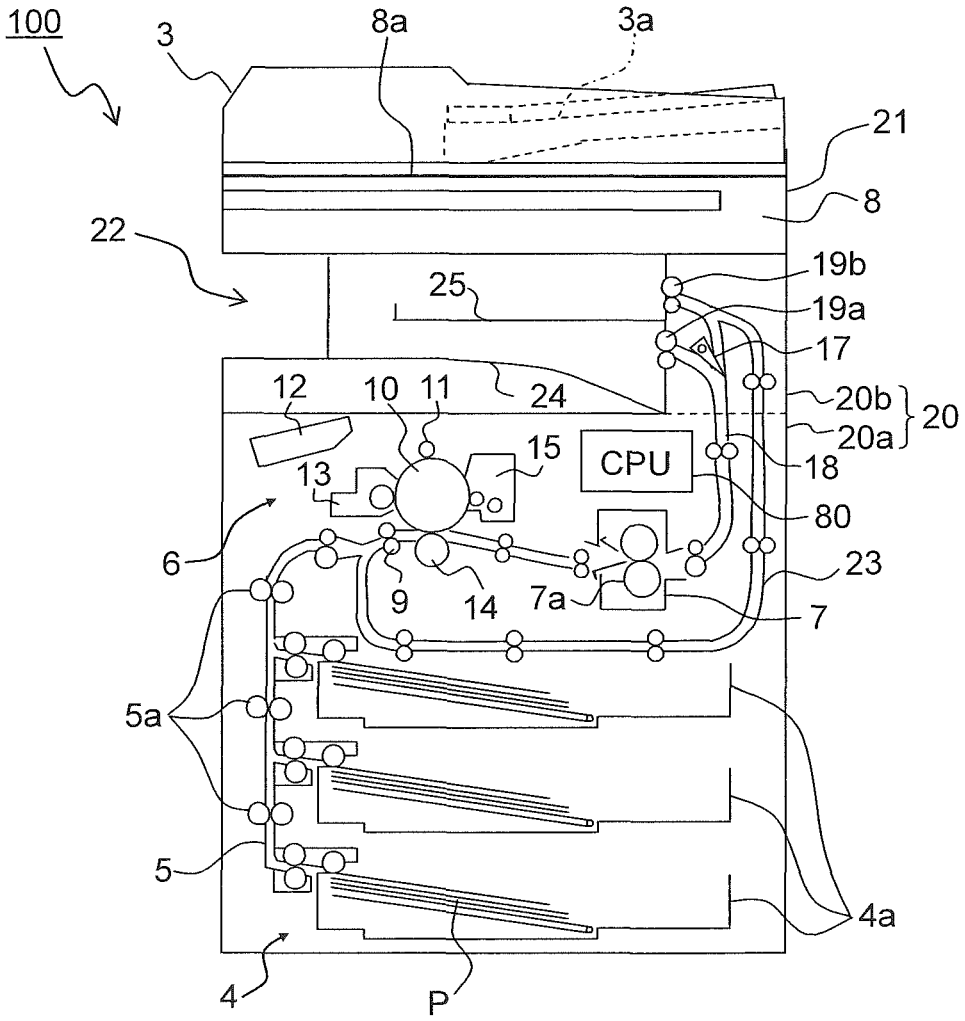
FIG. 1 is a schematic sectional view showing an internal structure of an image forming apparatus incorporating a solenoid according to the present disclosure.
Figure 2:
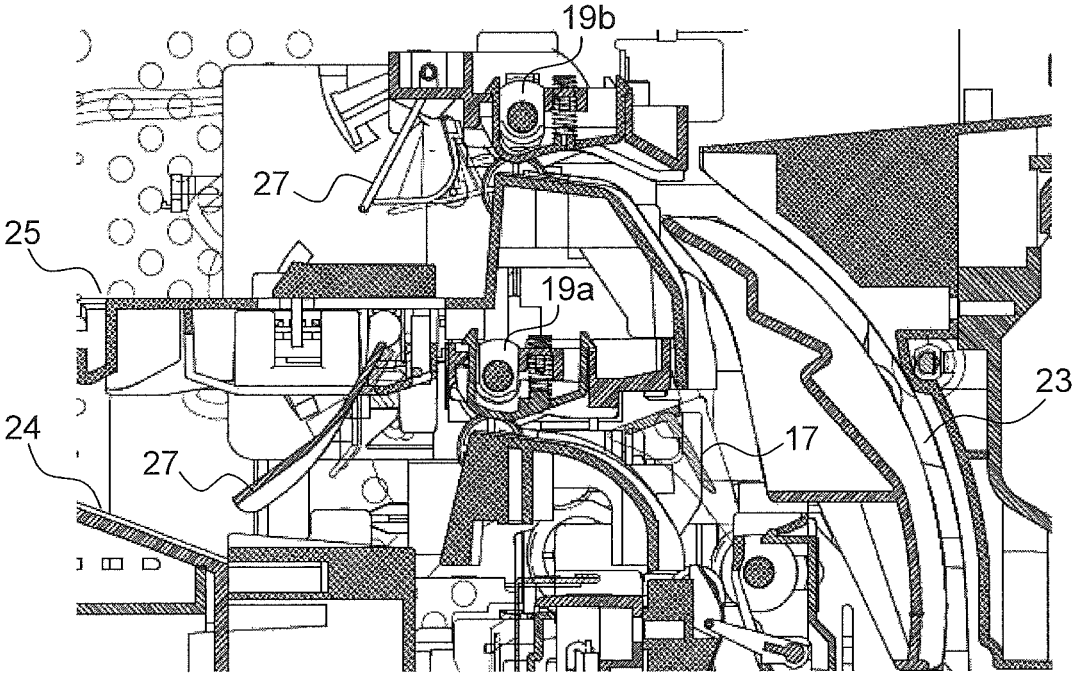
FIG. 2 is an enlarged view around a sheet discharge portion in the image forming apparatus in FIG. 1.

Hereinafter, an embodiment of the present disclosure will be described in detail with reference to the accompanying drawings. FIG. 1 is a schematic diagram showing an internal structure of an image forming apparatus 100 incorporating a solenoid 30 according to the present disclosure. FIG. 2 is an enlarged view around a sheet discharge portion in the image forming apparatus 100 in FIG. 1. As shown in FIG. 1, the image forming apparatus 100 is a digital multifunction peripheral of a so-called internal sheet discharge type, and roughly includes a body housing 20 and an upper housing 21 arranged over it. In the upper housing 21, various mechanisms as will be described later are provided for reading an image of a document as an electrical signal, and over the upper housing 21, a document conveying device 3 is provided. On the other hand, in the body housing 20, various mechanisms as will be described later are provided for transferring to a sheet an image formed based on the electrical signal of the document image which has been read. In the image forming apparatus 100, a control portion (CPU) 80 is arranged for controlling the operation of devices and members in the image forming apparatus 100.

In this embodiment, the body housing 20 includes a lower housing 20*a* and a coupling housing 20*b* which is arranged above the lower housing 20*a* along a right side part in FIG. 1 and which is coupled to the upper housing 21. In the lower housing 20*a*, there are arranged a sheet feed portion 4 for sheets P, an image forming portion 6 for forming a toner image on a sheet P, a fixing portion 7 for fixing the toner image formed on the sheet P, and the like. On the other hand, in the coupling housing 20*b*, the sheet discharge portion is arranged for conveying the sheet P which has been subjected to fixing to discharge the sheet P out of the body housing 20. On the left side of the coupling housing 20*b* right under the upper housing 21, there is formed an internal discharge space 22 widely open to the left side face and the front face of the image forming apparatus 100.

The body housing 20 includes inside it the sheet feed portion 4 arranged in a lower part of the body housing 20, a sheet conveying portion 5 arranged to a side of and above the sheet feed portion 4, the image forming portion 6 arranged over the sheet feed portion 4, and the fixing portion 7 arranged on the downstream side (the right side in FIG. 1) of the image forming portion 6 in the sheet conveying direction. The image forming portion 6 and the fixing portion 7 are arranged to extend in the width direction orthogonal to the sheet conveying direction inside the image forming apparatus 100 (in the direction perpendicular to the plane of FIG. 1).

The sheet feed portion 4 includes a plurality of sheet feed cassettes 4*a* provided with a separating/feeding means such as a sheet feeding roller on the downstream side in the sheet conveying direction. A bundle of sheets P placed in these sheet feed cassettes 4*a* are, as the sheet feeding roller rotates, fed one sheet after another starting with the topmost sheet P to the sheet conveying portion 5. The sheet conveying portion 5 conveys the sheet P fed from the sheet feed portion 4 to the image forming portion 6 with the conveying roller pairs 5*a*.

The image forming portion 6 forms a predetermined toner image on a sheet P through an electrophotographic process, and includes a photosensitive drum 10, which is an image carrying member that is rotatably supported, and a charging device 11, an exposing device 12, a developing device 13, a transfer device 14, a cleaning device 15, and an unillustrated destaticizer, which are arranged around this photosensitive drum 10 along its rotation direction. The fixing portion 7 heats and presses the sheet P having the toner image formed on it in the image forming portion 6 while holding it between a fixing roller pair 7*a* including a heating roller and a pressing roller to fix the unfixed toner image to the sheet P.

In the upper housing 21, an image reading portion 8 is provided. The image reading portion 8 reads image data of a document, and when a document which is placed manually one sheet after another is read, with the document conveying device 3 open, a document sheet is placed on a contact glass 8*a* arranged on the top face of the upper housing 21. On the other hand, when a document bundle is read automatically one sheet after another, the document bundle is placed on a sheet feed tray 3*a* of the document conveying device 3 in a closed state. When a document bundle is placed on the sheet feed tray 3*a*, the document is automatically fed one sheet after another sequentially out of the document bundle onto the contact glass 8*a*. In either case, a document sheet placed on the contact glass 8*a* is irradiated with light from an unillustrated exposure lamp, and the reflected light is directed as image light via an optical system including a reflection mirror, an imaging lens, and the like of which none is illustrated to a photoelectric conversion portion (CCD).

Now, a description will be given of the basic operation of the image forming apparatus 100 configured as described above. First, the surface of the photosensitive drum 10 that rotates in the counter-clockwise direction in FIG. 1 is electrostatically charged uniformly by the charging device 11. Subsequently, based on the image data read in the image reading portion 8, the circumferential surface of the photosensitive drum 10 is irradiated with a laser beam from the exposing device 12 (such as a laser scanner unit), and thereby an electrostatic latent image is formed on the surface of the photosensitive drum 10. To this electrostatic latent image, toner as developer is fed from the developing device 13, and thereby a toner image is formed.

In parallel with toner image formation, a sheet P is fed out from the sheet feed portion 4 to the sheet conveying portion 5, and is stopped temporarily at a registration roller pair 9. Then, the sheet P stopped at the registration roller pair 9 is conveyed, with predetermined timing, toward the photosensitive drum 10 having the toner image formed on it, where the toner image on the surface of the photosensitive drum 10 is transferred to the sheet P by the transfer device 14 comprising a transfer roller or the like. Then, the sheet P having the toner image transferred to it is separated from the photosensitive drum 10, is conveyed toward the fixing portion 7, and passes through the fixing roller pair 7*a* so that the toner image is fixed under application of heat and pressure.

The photosensitive drum 10 is, after completion of transfer of the toner image to the sheet P, subjected to removal of unused toner left on the circumferential surface and then to a discharging process in which remaining electric charge is removed by the destaticizer (unillustrated). Then, the circumferential surface is again electrostatically charged by the charging device 11, and thereafter image formation proceeds in the same manner.

Then, the sheet P having passed through the fixing portion 7 is conveyed, as it is, into the coupling housing 20*b* along a vertical conveying passage 18 extending perpendicularly upward. An upper part of the vertical conveying passage 18 branches leftward into upper and lower conveying passages in the coupling housing 20*b*, and by a switching guide 17 arranged in a branching portion, the conveying direction of the sheet P is switched.

In this coupling housing 20*b*, the sheet discharge portion is arranged which includes a first discharge roller pair 19*a* and a second discharge roller pair 19*b* arranged right over the first discharge roller pair 19*a*. The sheet P conveyed through the vertical conveying passage 18 is guided into the upper or the lower conveying passage by the switching guide 17.

The sheet P guided into the lower conveying passage by the switching guide 17 is discharged out to the left from the first discharge roller pair 19*a*, and is stacked on a first sheet discharge tray 24 formed on the bottom face of the internal discharge space 22. On the other hand, the sheet P guided into the upper conveying passage by the switching guide 17 is discharged out to the left from the second discharge roller pair 19*b*, and is discharged onto a second sheet discharge tray 25. The switching guide 17 switches the guide direction of the sheet P according to a control signal from the control portion 80. Close to the downstream side of the first discharge roller pair 19*a* and of the second discharge roller pair 19*b* in the sheet discharge direction, a sheet pressing member 27 is swingably provided for pressing from above the tail end of the sheet P discharged from the first discharge roller pair 19*a* and from the second discharge roller pair 19*b*.

On the other hand, when printing is performed on both sides of the sheet P, the sheet P having passed through the fixing portion 7 is guided into the upper conveying passage by the switching guide 17. Then, part of the sheet P is momentarily stuck out of the apparatus via the second discharge roller pair 19*b*. Then, the second discharge roller pair 19*b* is rotated in the reverse direction so that the conveying direction is switched (switchback), with the result that the sheet P is distributed into a reverse conveying passage 23, and the sheet P is, with the image side reversed, conveyed once again to the registration roller pair 9. Then, the next image formed on the photosensitive drum 10 is transferred by the transfer device 14 to the side of the sheet P on which no image has yet been formed. Then, the sheet P is, after being conveyed to the fixing portion 7, where the toner image is fixed, discharged via the first discharge roller pair 19*a* onto the first sheet discharge tray 24.

With the above-described configuration in which a sheet P subjected to double-sided printing is switched back by use of the second discharge roller pair 19*b*, during switchback of the sheet P, a succeeding sheet P can be discharged via the first discharge roller pair 19*a* onto the first sheet discharge tray 24.

Also a user can switch the guide direction of a sheet P on an operation panel (unillustrated). For example, the sheet P having undergone regular image formation can be discharged via the first discharge roller pair 19*a* onto the first sheet discharge tray 24, and when data received from a facsimile machine or the like is printed, a sheet P can be discharged via the second discharge roller pair 19*b* onto the second sheet discharge tray 25.

Figure 3:
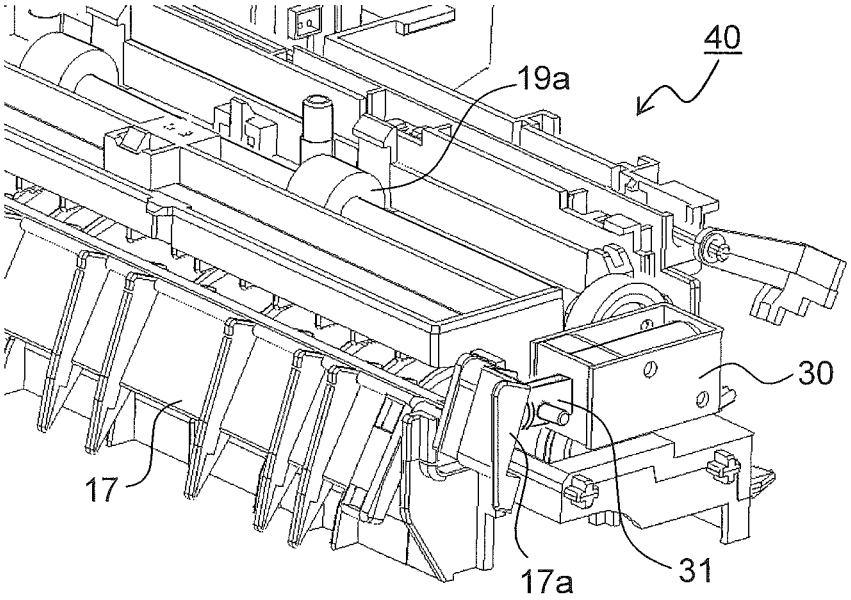
FIG. 3 is a partial perspective view of a discharge unit provided with a switching guide, showing a state where the switching guide is arranged in a position to guide a sheet to a first discharge roller pair.
Figure 4:
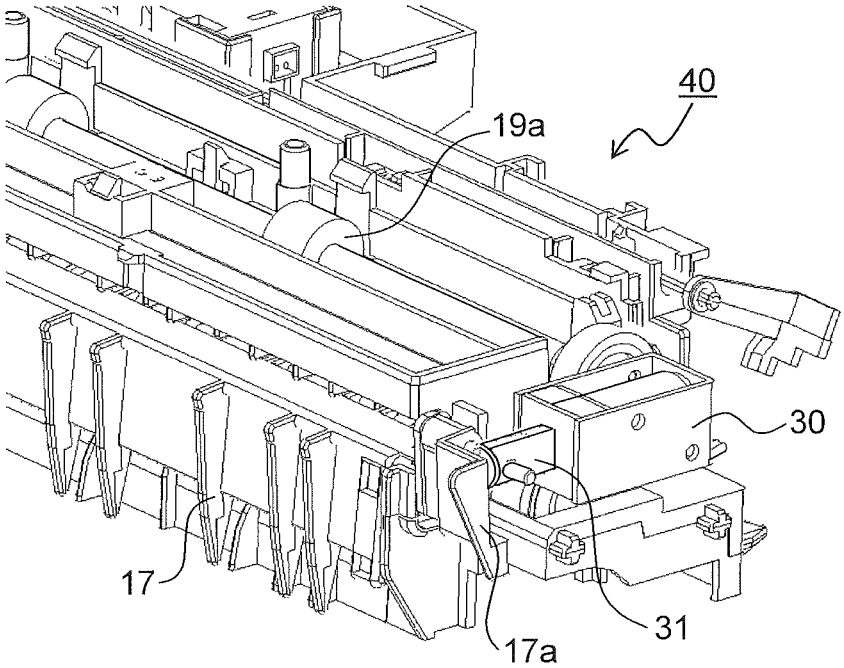
FIG. 4 is a partial perspective view of the discharge unit provided with the switching guide, showing a state where the switching guide is arranged in a position to guide a sheet to a second discharge roller pair.

FIGS. 3 and 4 are partial perspective views of a discharge unit 40 provided with the switching guide 17, respectively showing a state where the switching guide 17 is arranged in a position to guide a sheet P to the first discharge roller pair 19*a* and a state where the switching guide 17 is arranged in a position to guide a sheet P to the second discharge roller pair 19*b*. FIGS. 3 and 4 show the discharge unit 40 as seen from behind the image forming apparatus 100 (from the rear side with respect to the plane of FIG. 1).

The discharge unit 40 includes the first discharge roller pair 19*a*, the switching guide 17, and the solenoid 30. The switching guide 17 is swingably supported on a case of the discharge unit 40, and has an arm portion 17*a* formed in an end part of a swing shaft. To the arm portion 17*a*, a plunger 31 of the solenoid 30 is coupled.

Figure 5:
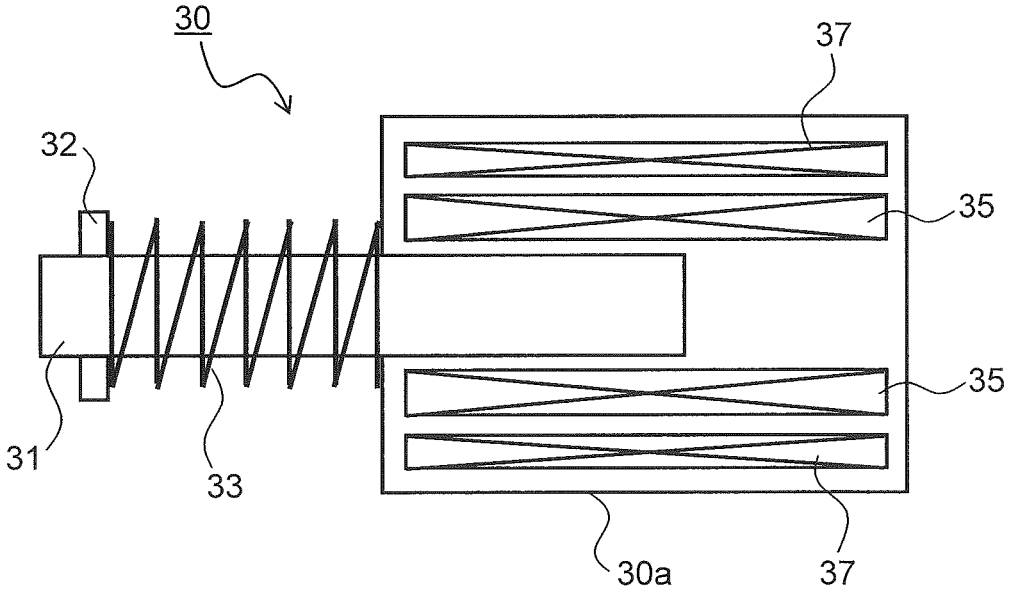
FIG. 5 is a sectional view of the solenoid according to one embodiment of the present disclosure, showing a state where a plunger protrudes out of a solenoid body.

FIG. 5 is a sectional view of the solenoid 30, which changes the position of the switching guide 17, according to one embodiment of the present disclosure. The solenoid 30 has the plunger 31, of which the movement is controlled by the control portion 80 (see FIG. 1). Thus, a solenoid device according to the present disclosure includes the solenoid 30 and the control portion 80 (see FIG. 1). The solenoid 30 has the plunger 31 which is made of iron and which can protrude out of and be pulled into a solenoid body 30*a*. At the tip end of the plunger 31, a locking portion 32 is formed, and around the plunger 31 between the solenoid body 30*a* and the locking portion 32, a coil spring 33 is fitted.

In the solenoid body 30*a*, there are arranged an attracting coil 35 and a retaining coil 37 which are in a cylindrical shape. The attracting coil 35 is arranged so as to surround the circumferential surface of the plunger 31 with the plunger 31 pulled inside the solenoid body 30*a*. The retaining coil 37 is arranged so as to surround the circumferential surface of the attracting coil 35. The attracting and retaining coils 35 and 37 have coil windings spiraling in the same direction. The coil winding of the retaining coil 37 has a higher electrical resistance than the coil winding of the attracting coil 35.

Next, a description will be given of the operation of the solenoid 30 according to the embodiment. FIG. 5 shows a state (returning state) where the plunger 31 protrudes out of the solenoid body 30*a*. Applying a voltage to the attracting coil 35 from the state in FIG. 5 causes the plunger 31 to be magnetically excited by the magnetic field lines generated by the attracting coil 35, and thereby a force is generated that causes the plunger 31 to move in a direction (from the left to right in FIG. 5) into the solenoid body 30*a*. This causes the plunger 31 to be pulled into the solenoid body 30*a* against the biasing force of the coil spring 33 as shown in FIG. 6.

Figure 6:
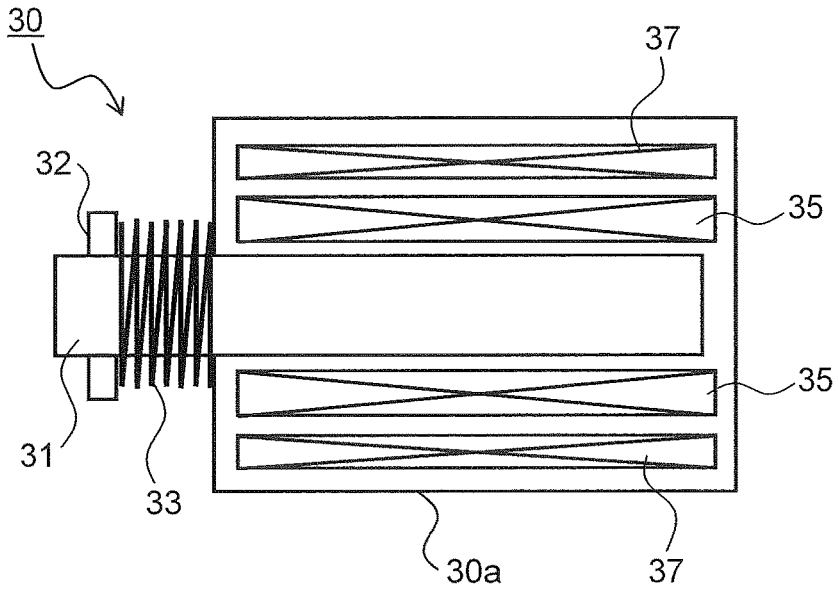
FIG. 6 is a sectional view of the solenoid according to the embodiment, showing a state where the plunger is pulled into the solenoid body.

When a sheet P is discharged onto the first sheet discharge tray 24, the solenoid 30 is brought into an attracted state as shown in FIG. 6. Thus, as shown in FIG. 3, the plunger 31 pulled into the solenoid body 30*a* causes the arm portion 17*a* to swing in the clockwise direction, and thus the switching guide 17 also swings in the clockwise direction (horizontal direction). As a result, the switching guide 17 is arranged in a position (hereinafter, referred to as a first position) to guide a sheet P along the rear face side (the lower face side in FIG. 3) of the switching guide 17 to the first discharge roller pair 19*a*. After the switching guide 17 is arranged in the first position, a voltage is applied to the retaining coil 37, and thereby the plunger 31 remains in the attracted state even when the application of the voltage to the attracting coil 35 is stopped.

Stopping the application of the voltage to the retaining coil 37 from the state in FIG. 6 causes the plunger 31 to protrude out of the solenoid body 30*a* by the biasing force of the coil spring 33 and thereby to return to the returning state shown in FIG. 5. Then, the plunger 31 is held in the returning state by the coil spring 33.

When a sheet P is discharged onto the second sheet discharge tray 25, the solenoid 30 is brought into the returning state shown in FIG. 5. Thus, as shown in FIG. 4, the plunger 31 protruded out of the solenoid body 30*a* causes the arm portion 17*a* to swing in the counter-clockwise direction, and thus the switching guide 17 also swings in the counter-clockwise direction (vertical direction). As a result, the switching guide 17 is arranged in a position (hereinafter, referred to as a second position) to guide a sheet P along the obverse face side (the left face side in FIG. 4) of the switching guide 17 to the second discharge roller pair 19*b*.

When a sheet P is subjected to double-sided printing, during first side (obverse side) printing, the switching guide 17 is arranged in the second position to discharge the sheet P onto the second sheet discharge tray 25; during second side (reverse side) printing, the switching guide 17 is arranged in the first position to discharge the sheet P onto the first sheet discharge tray 24. The first-side printing and the second-side printing are alternately repeated with a very small interval (sheet interval) of about 500 msec between sheets P; this makes it necessary to promptly switch the position of the switching guide 17. To achieve that, a large current (about 1A) is passed through the coil winding of the attracting coil 35 so that the attracting coil 35 attracts with a strong force the plunger 31 that moves the switching guide 17.

When sheets P are successively discharged onto the first sheet discharge tray 24, the switching guide 17 needs to be held in the first position, and thus the solenoid 30 needs to hold the plunger 31 in the attracted state for a long time. However, holding the plunger 31 in the attracted state for a long time by the attracting coil 35, through which a large current passes, inconveniently overheats the solenoid 30.

A solenoid device (keep solenoid) is known of a type that holds, by use of a permanent magnet, a plunger in an attracted state with no current passing through it. The use of the permanent magnet however increases the cost. When the keep solenoid is used, to suppress impact noise generated by movement of the plunger, a control device which controls a voltage applied to a attracting coil needs to have a PWM (pulse width modulation) function to vary the duty cycle of a pulse width (the ratio between H and L of a pulse width) according to the size (DC level) of an input signal without varying the frequency; this increases the cost.

The force that holds the plunger 31 in the attracted state is not required to be as strong as the force that brings the plunger 31 into the attracted state out of the returning state. Thus, in this embodiment, to hold the plunger 31 in the attracted state, the retaining coil 37 is used, through which only a small current passes. The coil winding of the retaining coil 37 has a higher (here about ten times higher) electrical resistance than the coil winding of the attracting coil 35, and thus only a current of about 0.1 A passes through the retaining coil 37. This eliminates problems associated with overheating of the solenoid 30.

Figure 10A:
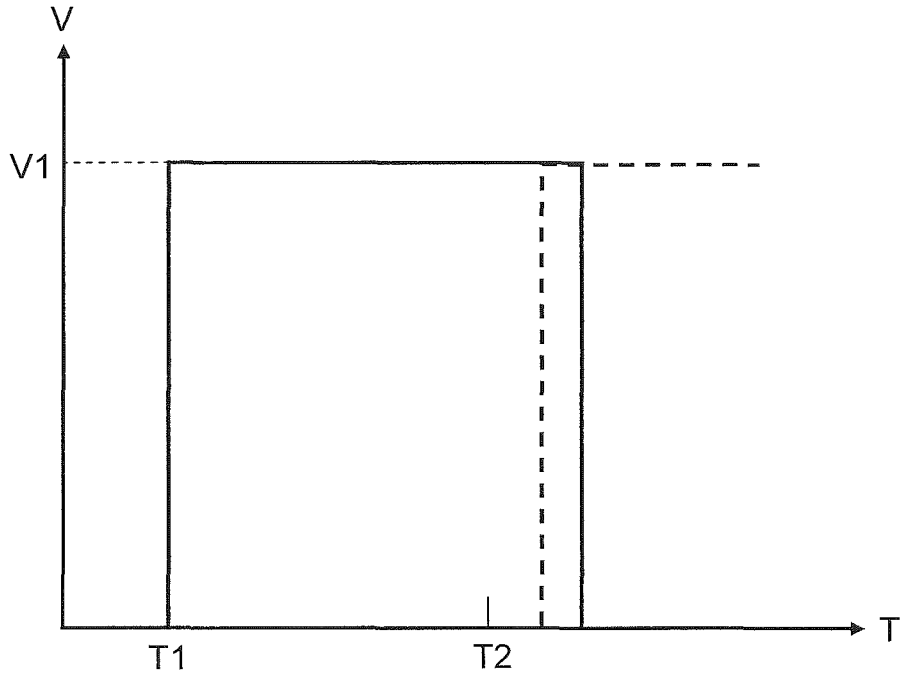
FIG. 10A is a diagram showing variation in a voltage applied to an attracting coil and a retaining coil when a plunger is switched from a returning state to an attracted state in a conventional solenoid device.
Figure 10B:
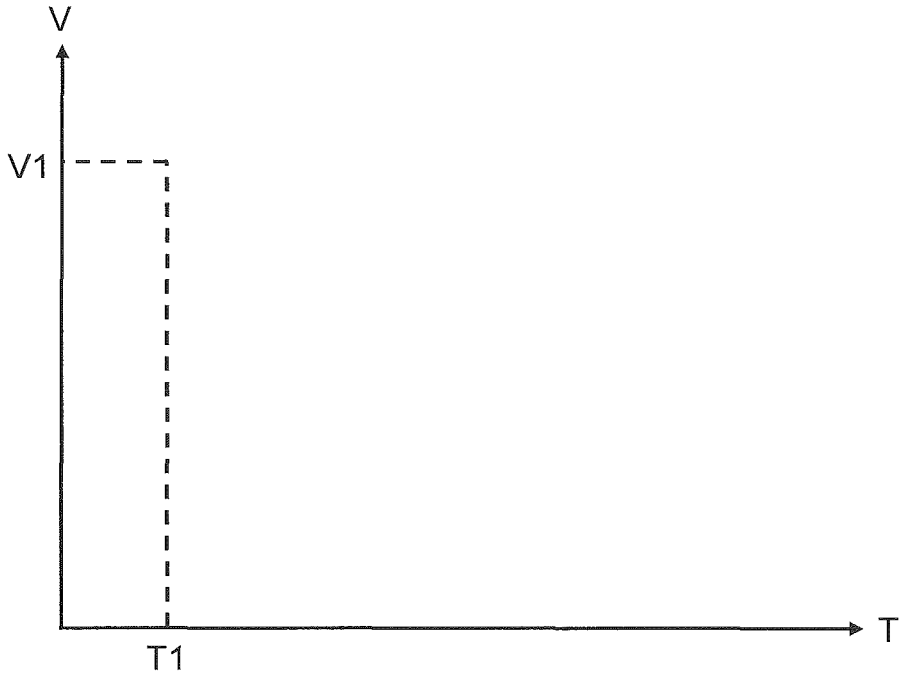
FIG. 10B is a diagram showing variation in a voltage applied to the retaining coil when the plunger is switched from the attracted state to the returning state in the conventional solenoid device.

Next, a detailed description will be given of a procedure for applying a voltage during switching operation of the switching guide 17 by use of the solenoid 30 according to the embodiment. FIG. 10A is a diagram showing variation in a voltage applied to the attracting coil 35 and the retaining coil 37 when the plunger 31 is switched from the returning state to the attracted state in a conventional solenoid device. FIG. 10B is a diagram showing variation in a voltage applied to the retaining coil 37 when the plunger 31 is switched from the attracted state to the returning state in the conventional solenoid device. In FIGS. 10A and 10B, and in FIGS. 7 and 8, which will be described later, the voltage applied to the attracting coil 35 is indicated by a solid line, and the voltage applied to the retaining coil 37 is indicated by a broken line. Switching of the voltage applied to the attracting coil 35 and the retaining coil 37 is controlled by the control portion 80 (see FIG. 1).

Conventionally, when the plunger 31 is switched from the returning state to the attracted state, as shown in FIG. 10A, a fixed voltage V1 is applied to the attracting coil 35 from the start time T1 of attracting operation, and at the lapse of an estimated completion time T2 set by predicting completion of attracting operation, a voltage V1 starts to be applied to the retaining coil 37 (the broken line in FIG. 10A), and immediately thereafter the application of the voltage to the attracting coil 35 is stopped (the solid line in FIG. 10A).

In this case, from immediately after the start of attracting, a strong attracting force acts on the plunger 31 by the attracting coil 35, and this results in a strong impact occurring when the position of the switching guide 17 is switched from the second position to the first position.

On the other hand, when the plunger 31 is switched from the attracted state to the returning state, as shown in FIG. 10B, the application of the voltage V1 to the retaining coil 37 is stopped at the start time T1 of returning operation (the broken line in FIG. 10B) so that the plunger 31 is moved only by the biasing force (restoring force) of the coil spring 33. As a result, a strong impact occurs also when the position of the switching guide 17 is switched from the first position to the second position.

As a solution, in the present disclosure, the timing of the application of a voltage to the attracting coil 35 and the retaining coil 37 during switching operation of the plunger 31 is adjusted so as to reduce the speed of the plunger 31 during switching operation and thereby reduce the impact occurring when the operation is completed.

Figure 7:
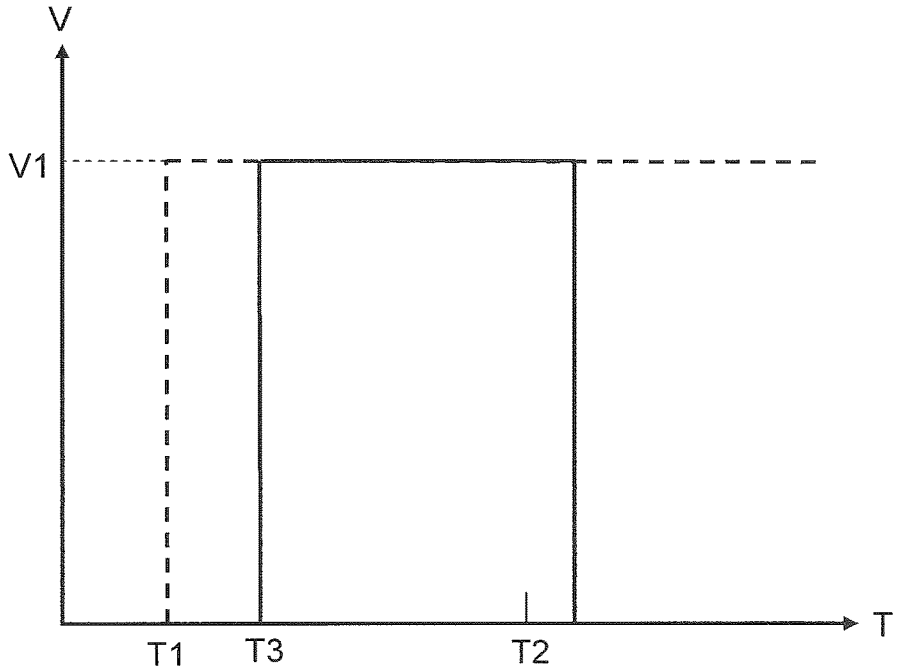
FIG. 7 is a diagram showing variation in a voltage applied to an attracting coil and a retaining coil during attracting operation of the plunger in the solenoid according to the embodiment.
Figure 8:
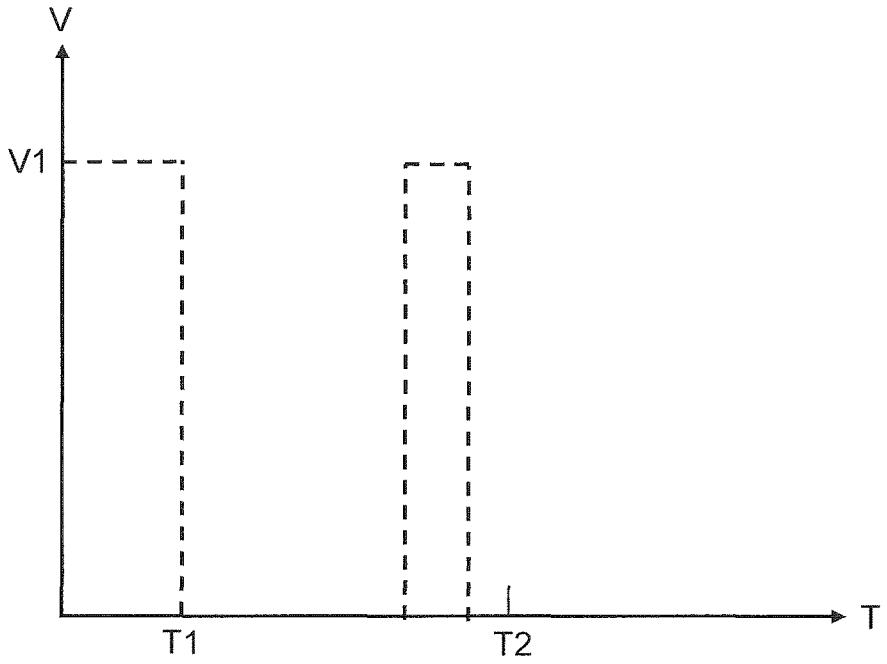
FIG. 8 is a diagram showing variation in a voltage applied to the retaining coil during returning operation of the plunger in the solenoid according to the embodiment.

FIG. 7 is a diagram showing variation in a voltage applied to the attracting coil 35 and the retaining coil 37 during attracting operation of the plunger 31 in the solenoid 30 according to the embodiment. FIG. 8 is a diagram showing variation in a voltage applied to the retaining coil 37 during returning operation of the plunger 31.

When the plunger 31 is switched from the returning state to the attracted state, as shown in FIG. 7, first, a voltage V1 is applied to the retaining coil 37 at the start time T1 of attracting operation (the broken line in FIG. 7). This causes the plunger 31 to be magnetically excited by the magnetic field lines generated by the retaining coil 37 and thus to start to be pulled into the solenoid body 30*a* by a weak force.

Then, at the time T3 (here at the lapse of about 50 msec from T1), a voltage V1 starts to be applied to the attracting coil 35 (the solid line in FIG. 7). As a result, the plunger 31 starts to be pulled into the solenoid body 30*a* by a strong force. Here, by the application of the voltage V1 to the retaining coil 37, the plunger 31 has already been pulled into the solenoid body 30*a* by a predetermined distance; this shortens the time for which the force acts on the plunger 31 from the start of the application of the voltage V1 to the attracting coil 35 to the completion of attracting operation. Thus, the pulling speed of the plunger 31 immediately prior to the completion of attracting operation is suppressed to be lower than in the conventional configuration; this reduces the impact occurring when the position of the switching guide 17 is switched from the second position to the first position as compared with the conventional configuration, and also suppresses the impact noise. Then, after the completion of attracting operation, the application of the voltage V1 to the attracting coil 35 is stopped (the solid line in FIG. 7).

When the plunger 31 is switched from the attracted state to the returning state, as shown in FIG. 8, the application of the voltage V1 to the retaining coil 37 is stopped at the start time T1 of returning operation (the broken line in FIG. 8); this causes the plunger 31 to start to be pushed out by the restoring force (biasing force) of the coil spring 33. Then, at the lapse of a predetermined time from T1, immediately prior to the estimated completion time T2 set by predicting completion of returning operation, a voltage V1 is applied again to the retaining coil 37 for a short time (the broken line in FIG. 8). As a result, a force acts on the plunger 31 in the direction opposite to the returning direction, and thus the moving speed of the plunger 31 is reduced. This reduces the impact occurring when the position of the switching guide 17 is switched from the second position to the first position as compared with the conventional configuration, and also suppresses the impact noise.

Applying a voltage by following the procedure described above helps avoid increasing more than necessary the pull-in force of the plunger 31 immediately prior to the completion of attracting operation and the push-out force of the plunger 31 immediately prior to the completion of returning operation, with the result that the impact occurring when the plunger 31 is pulled into or protrudes out of the solenoid body 30*a* is alleviated. Thus, it is possible to effectively suppress occurrence of impact noise between the plunger 31 and the solenoid body 30*a* and of their vibration, and thus to smoothly switch the switching guide 17 between the first position and the second position.

It is unnecessary to use a permanent magnet for holding the plunger 31 in the attracted state or to adopt a PWM (pulse width modulation) system in switching control of a voltage, and thus cost reduction of the solenoid 30 can be achieved.

Figure 9:
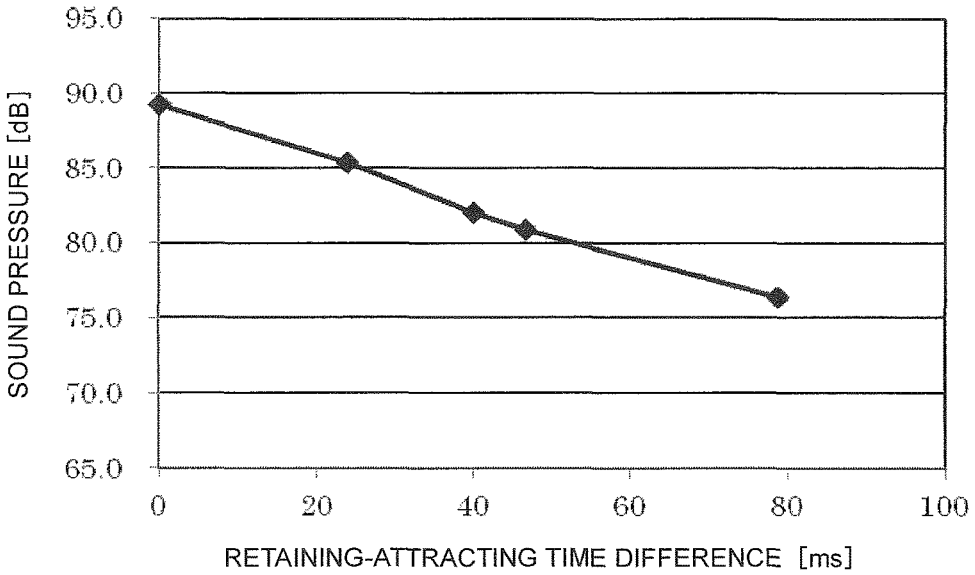
FIG. 9 is a diagram showing the relationship between the time taken after a voltage is applied to the retaining coil until a voltage is applied to the attracting coil when the plunger is switched from a returning state to an attracted state and impact noise occurring when the switching guide is switched.

FIG. 9 is a diagram showing the relationship between the time taken after a voltage is applied to the retaining coil 37 until a voltage is applied to the attracting coil 35 when the plunger 31 is switched from the returning state to the attached state and the impact noise occurring when the switching guide 17 is switched. As shown in FIG. 9, when a voltage was applied only to the attracting coil 35 at the start of attracting operation, the sound pressure of the impact noise was about 90 dB. When a voltage was applied to the attracting coil 35 at the lapse of 24 msec, 40 msec, 48 msec, and 79 msec after a voltage was applied to the retaining coil 37 at the start of attracting operation, the sound pressure of the impact noise was about 85 dB, 82 dB, 80 dB, and 76 dB respectively.

That is, the longer the time taken after a voltage is applied to the retaining coil 37 until a voltage is applied to the attracting coil 35, the lower the impact noise occurring. On the other hand, the longer the time taken until a voltage is applied to the attracting coil 35, the weaker the attracting force by which the plunger 31 is pulled into the solenoid body 30*a*, and thus the longer the switching operation time of the switching guide 17; this makes it difficult to deal with a small interval between sheets P.

Thus, the timing of the application of a voltage to the attracting coil 35 can be set as necessary, according to conditions such as the spring constant of the coil spring 33, the numbers of turns of the attracting coil 35 and the retaining coil 37, the conveying speed of a sheet P, and the interval between sheets P, within the time from the start time of the application of a voltage to the retaining coil 37 (the start time T1 of attracting operation) to the estimated completion time T2 of attracting operation.

In this embodiment, a voltage is applied to the attracting coil 35 at the lapse of about 50 msec after a voltage is applied to the retaining coil 37 so that the impact noise can be reduced to about 80 dB while the switching operation time of the switching guide 17 is kept within a predetermined time. The level of the voltage V1 applied to the attracting coil 35 and the retaining coil 37 can be also set as necessary according to the conditions mentioned above.

The embodiments described above are in no way meant to limit the present disclosure, which thus allows for many modifications and variations within the spirit of the present disclosure. For example, although in the above-described embodiment, a switching guide 17 can be moved by use of the solenoid 30, the member that can be moved by the solenoid 30 is not limited to the switching guide 17; it may be any other member in the image forming apparatus 100.

The present disclosure is applicable not only to monochrome multifunction peripherals like the one shown in FIG. 1 but also to other types of image forming apparatuses such as color copiers, monochrome and color printers, and facsimile machines, and to other electronic devices incorporating a solenoid device.

The present disclosure is applicable to a solenoid device of a push-pull type that moves a plunger between an attracted position and a returning position. Based on the present disclosure, it is possible to provide a solenoid device that can suppress, with a simple configuration, impact noise occurring between a plunger and a member that can be moved by the plunger, and to provide an image forming apparatus incorporating such a solenoid device.

What is claimed is:

1. A solenoid device comprising:

a solenoid including;

a solenoid body, a plunger arranged selectively either in an attracted position where the plunger is pulled into the solenoid body or in a returning position where the plunger protrudes out of the solenoid body, an attracting coil arranged in the solenoid body, the attracting coil generating, when a voltage is applied thereto, an attracting force that causes the plunger to move from the returning position to the attracted position, a retaining coil arranged in the solenoid body, the retaining coil generating, when a voltage is applied thereto, a retaining force that causes the plunger to move to the attracted position and that is weaker than the attracting force of the attracting coil, and a biasing member which biases the plunger toward the returning position; and a control portion which controls operation of the solenoid, wherein when performing attracting operation to move the plunger from the returning position to the attracted position, the control portion first starts to apply the voltage to the retaining coil and then starts to apply the voltage to the attracting coil.

2. The solenoid device of claim 1, wherein after completion of the attracting operation, the control portion stops applying the voltage to the attracting coil while continuing applying the voltage to the retaining coil.

3. The solenoid device of claim 1, wherein a coil winding forming the retaining coil has a higher electrical resistance than a coil winding forming the attracting coil.

4. The solenoid device of claim 1, wherein the attracting coil is formed in a cylindrical shape to surround a circumferential surface of the plunger in the attracted position, the retaining coil is formed in a cylindrical shape to surround a circumferential surface of the attracting coil, and the attracting coil and the retaining coil have coil windings spiraling in a same direction.

5. A solenoid device comprising:

a solenoid including;

a solenoid body, a plunger arranged selectively either in an attracted position where the plunger is pulled into the solenoid body or in a returning position where the plunger protrudes out of the solenoid body, an attracting coil arranged in the solenoid body, the attracting coil generating, when a voltage is applied thereto, an attracting force that causes the plunger to move from the returning position to the attracted position, a retaining coil arranged in the solenoid body, the retaining coil generating, when a voltage is applied thereto, a retaining force that causes the plunger to move to the attracted position and that is weaker than the attracting force of the attracting coil, and a biasing member which biases the plunger toward the returning position; and a control portion which controls operation of the solenoid, wherein when performing attracting operation to move the plunger from the returning position to the attracted position, the control portion first starts to apply the voltage to the retaining coil and then starts to apply the voltage to the attracting coil, and, when performing returning operation to move the plunger from the attracted position to the returning position, the control portion first stops applying the voltage to the retaining coil and then applies a voltage to the retaining coil immediately prior to completion of the returning operation.

6. The solenoid device of claim 5, wherein after completion of the attracting operation, the control portion stops applying the voltage to the attracting coil while continuing applying the voltage to the retaining coil.

7. The solenoid device of claim 5, wherein when performing returning operation to move the plunger from the attracted position to the returning position, the control portion first stops applying the voltage to the retaining coil and then applies a voltage to the retaining coil immediately prior to an estimated completion time set by predicting completion of the returning operation.

8. The solenoid device of claim 5, wherein a coil winding forming the retaining coil has a higher electrical resistance than a coil winding forming the attracting coil.

9. The solenoid device of claim 5, wherein the attracting coil is formed in a cylindrical shape to surround a circumferential surface of the plunger in the attracted position, the retaining coil is formed in a cylindrical shape to surround a circumferential surface of the attracting coil, and the attracting coil and the retaining coil have coil windings spiraling in a same direction.

10. An image forming apparatus comprising:

a solenoid device including:

a solenoid including;

a solenoid body, a plunger arranged selectively either in an attracted position where the plunger is pulled into the solenoid body or in a returning position where the plunger protrudes out of the solenoid body, an attracting coil arranged in the solenoid body, the attracting coil generating, when a voltage is applied thereto, an attracting force that causes the plunger to move from the returning position to the attracted position, a retaining coil arranged in the solenoid body, the retaining coil generating, when a voltage is applied thereto, a retaining force that causes the plunger to move to the attracted position and that is weaker than the attracting force of the attracting coil, and a biasing member which biases the plunger toward the returning position; and a control portion which controls operation of the solenoid, wherein when performing attracting operation to move the plunger from the returning position to the attracted position, the control portion first starts to apply the voltage to the retaining coil and then starts to apply the voltage to the attracting coil;

an image forming portion forming an image on a sheet;

a sheet conveying passage conveying the sheet to the image forming portion;

and a movable member driven by the plunger of the solenoid device.

11. The image forming apparatus of claim 10, wherein the movable member is a switching guide to switch a sheet conveying direction in the sheet conveying passage.

* * * * *